United States Patent [19]

Yamaji et al.

[11] Patent Number: 5,049,159

[45] Date of Patent: Sep. 17, 1991

[54] DEODORIZING MATERIAL AND PROCESS FOR PRODUCING THE SAME: CELLULOSE FIBERS TREATED WITH COPPER HYDROXIDE OR ZINC HYDROXIDE COLLOID SOLUTION

[75] Inventors: Keizou Yamaji; Natumi Satou; Eiji Morisaki, all of Saiki, Japan

[73] Assignee: Kohjin Co., Ltd., Tokyo, Japan

[21] Appl. No.: 449,924

[22] PCT Filed: Apr. 27, 1989

[86] PCT No.: PCT/JP89/00443

§ 371 Date: Dec. 13, 1989

§ 102(e) Date: Dec. 13, 1989

[87] PCT Pub. No.: WO89/12713

PCT Pub. Date: Dec. 28, 1989

[30] Foreign Application Priority Data

Jun. 23, 1988 [JP] Japan ..... 63-153471
Jul. 1, 1988 [JP] Japan ..... 63-162476
Oct. 18, 1988 [JP] Japan ..... 63-260435

[51] Int. Cl.[5] ..... D06M 15/03; D06M 21/00; D21H 5/22; A61L 9/01

[52] U.S. Cl. ..... 8/125; 8/115.68; 8/115.69; 8/116.1; 8/624; 8/629

[58] Field of Search ..... 8/115.69, 115.68, 125

[56] References Cited

FOREIGN PATENT DOCUMENTS 2444947 3/1975 Fed. Rep. of Germany .
54-131016 10/1979 Japan .
54-160900 12/1979 Japan .
62-238866 10/1987 Japan .
63-219700 9/1988 Japan .
1483088 8/1977 United Kingdom .

*Primary Examiner*—A. Lionel Clingman
*Attorney, Agent, or Firm*—Oliff & Berridge

[57] ABSTRACT

This invention is concerned with a process for producing deodorizing cellulose fibers on which a considerable amount of copper hydroxide and/or zinc hydroxide is fixed highly strongly, which process is characterized in that cellulose fibers are allowed to contact with a colloidal solution of copper hydroxide and/or zinc hydroxide prepared by adding an alkaline substance to an aqueous solution of a water-soluble copper compound and/or a water-soluble zinc compound. Deodorizing fibers so obtained are capable of effectively removing malodorous gaseous substances, such as hydrogen sulfide, ammonia, methyl mercaptan, etc., and exhibit excellent deodorizing effects. In addition, the deodorizing fibers, although they can be an excellent deodorizing material as they are, are excellent in workability and hence can be used in the form of a shaped product, including, e.g., granules, sheets, etc. They can therefore be applied to various uses in the field of deordorization.

12 Claims, No Drawings

DEODORIZING MATERIAL AND PROCESS FOR PRODUCING THE SAME: CELLULOSE FIBERS TREATED WITH COPPER HYDROXIDE OR ZINC HYDROXIDE COLLOID SOLUTION

FIELD OF THE INVENTION

The present invention relates to a deodorizing material useful for the removal of malodorous substances which are present in rooms, refrigerators, etc. or under various environment and to a process for producing the same.

BACKGROUND OF THE INVENTION

As deodorizing materials for removing malodorous substances, such as ammonia, methyl mercaptan, methyl sulfide dimethyl disulfide, hydrogen sulfide and trimethylamine, which are present in rooms, refrigerators, etc., there have hitherto been proposed those consisting mainly of activated carbon; those consisting of fibers or the like to which phthalocyanine complexes are attached; and those consisting of a carboxymethylated cellulose on which copper and/or zinc ions are adsorbed.

However, deodorants consisting mainly of activated carbon are in the form of granules, and they are colored in black. Therefore, the deodorants so employed are contained in a good-looking package. This results in bulkiness and poses various constraints on their use.

Deodorants consisting of fibers, such as celluloses, to which phthalocyanine complexes are attached are slow in the speed of deodorization and hence their deodorizing capability is insufficient from practical point of view.

Deodorants comprising carboxymethylated cellulose fibers on which copper and/or zinc ions are adsorbed could hardly be said to be a practical deodorizer since the ions are adsorbed thereon in only small quantities.

There has also been reported cellulose fibers dipped in a concentrated alkali solution of a copper compound to attain an increase in the quantity of ions adsorbed thereon. However, cellulose fibers so treated are severely damaged by the strong alkali and hence become unsatisfactory in workability, processability and other practical properties.

It has therefore been desired to develop a deodorizing material which is excellent in processability and exhibits excellent deodorizing properties.

SUMMARY OF THE INVENTION

As a result of intensive investigations, it has now been found that copper hydroxide and/or zinc hydroxide can be effectively attached to and fixed on cellulose fibers under certain conditions and that the fixed fibers so obtained exhibit excellent deodorizing effects against a wide range of malodorous substances, and the present invention has been accomplished on the basis of the finding.

Accordingly, the present invention is concerned with:

1) A process for producing deodorizing fibers, which is characterized in that copper hydroxide and/or zinc hydroxide is attached to cellulose fibers in a colloidal state and fixed thereon.

2) A process for producing deodorizing fibers as described in 1), wherein an alkaline substance is added to an aqueous solution of a water-soluble copper compound and/or a water-soluble zinc compound in which cellulose fibers are dispersed, so as to form colloid of copper hydroxide and/or zinc hydroxide and to fix the copper hydroxide and/or zinc hydroxide on said cellulose fibers through contact between them.

3) A process for producing deodorizing fibers as described in 1), wherein an alkaline substance is added to an aqueous solution of a water-soluble copper compound and/or a water-soluble zinc compound to form colloid of copper hydroxide and/or zinc hydroxide, and then cellulose fibers are charged and dispersed into the colloidal solution to fix the copper hydroxide and/or zinc hydroxide on the fibers through contact between them.

4) A process for producing deodorizing fibers as described in 1), wherein said cellulose fibers are treated with an acid before being dispersed into said aqueous solution of a water-soluble copper compound and/or a water-soluble zinc compound.

5) A process for producing deodorizing fibers as described in 1), wherein said cellulose fibers are dipped in an aqueous solution of chitosan before being dispersed into said aqueous solution of a water-soluble copper compound and/or zinc compound.

6) Deodorizing fibers consisting of cellulose fibers on which copper hydroxide and/or zinc hydroxide is attached and fixed in a colloidal state.

7) Deodorizing fibers as described in 6), wherein said copper hydroxide and/or zinc hydroxide is fixed on said cellulose fibers via a layer of chitosan.

8) Cellulose fibers as described in 6), wherein said cellulose fibers are pulp fibers.

9) A deodorizing material which comprises cellulose fibers on which copper hydroxide and/or zinc hydroxide is attached and fixed in a colloidal state.

10) A deodorizing material as described in 9), wherein said material is in the form of a sheet.

As examples of cellulose fibers usable in the present invention, mention may be made of pulp fibers, such as bleached sulfite pulps (e.g., NBSP, LBSP, NDSP, LDSP, etc.) and bleached kraft pulps (e.g., NBKP, LBKP, etc.); flaxes, such as Manila hemp, jute, etc.; cottons, such as cotton wool, cotton linter, etc.; natural fibers of kozo (paper mulberry), mitsumata (*Edgeworthis papyrifera*), etc. and their pulpy derivatives; rayon; and oxidized cellulose-containing fibers obtainable through oxidation of these fibers. These cellulose fibers can be used either individually or in combination of two or more of them.

In the present invention, deodorizing fibers are produced by fixing copper hydroxide and/or zinc hydroxide on at least one of the above-mentioned cellulose fibers by means of contact with a liquid containing colloids of copper hydroxide and/or zinc hydroxide.

If cellulose fibers are dipped in a dispersion containing copper hydroxide and/or zinc hydroxide in a non-colloidal solid state, the components could hardly be fixed strongly on the fibers, and particles of the components easily drop off during handling, resulting in a product which is not a practical deodorizer.

On the other hand, if cellulose fibers are dipped in a solution of copper hydroxide and/or zinc hydroxide in which no colloids are formed, the copper hydroxide and/or zinc hydroxide will attach to the cellulose fibers in only small quantities, and hence there will result a product which is only unsatisfactory as a practical deodorizing material.

Copper hydroxide and/or zinc hydroxide can be attached to and fixed on cellulose fibers in a colloidal state, e.g., in the following manner:

Method for Fixing

To an aqueous solution of a water-soluble copper compound and/or a water-soluble zinc compound in which cellulose fibers are dispersed is added an alkaline substance, so as to form colloid by adjusting its pH to 4.5 to 12 in the case of a copper compound or to 6.2 to 12 in the case of a zinc compound, preferably to 8.0 to 9.5 in either case. Or colloid is formed in the above manner, and then cellulose fibers are charged and dispersed into the colloid-containing solution. Copper hydroxide and/or zinc hydroxide is attached to and fixed on the cellulose fibers by way of contact between the colloid-containing solution and the fibers Colloidal particles could hardly be formed unless the pH is in the range of 4.5 to 12 in the case of a copper compound or in the range of 6.2 to 12 in the case of a zinc compound If the fixation is carried out at a pH lower than 8.0, the quantity of fixed compounds and the rate of their fixing will become lower and, on the contrary, if it is effected at a pH higher than 9.5, the cellulose fibers tend to become brittle. The pH range of from 8.0 to 9.5 is therefore preferred. The cellulose fibers, when subjected to the fixation at a relatively high pH, are preferably washed well with water.

In cases, in particular, where the pH is higher than ca. 12, the fibers are severely damaged since they are cellulosic, and after treatment of the resulting fibers, such as washing or the like, must be intensified. In addition, there will result an undesirable lowering in the strength of the fibers and deterioration in their processability.

In the deodorizing fibers of the present invention, the components which contribute to their capability of deodorization are present on the surface of the fibers and come into contact with malodorous gases, the subjects for deodorization, in an effective manner. Because of this, the deodorizing fibers provide an improved deodorizing effect compared with fibers obtained by means of dipping in a simple aqueous solution of a copper compound.

In the above-described preparation of aqueous solution of a water-soluble copper compound and/or a water-soluble zinc compound, the concentration of the components must be within the range where it is possible to form a colloidal solution when the pH is adjusted later.

Cellulose fibers can be subjected to an acid treatment by using, e.g., hydrochloric acid, sulfuric acid, sulfurous acid, nitric acid, etc. before being dispersed into the aqueous solution of a water-soluble copper and/or zinc compound. Alternatively, cellulose fibers can be subjected to a chitosan treatment, dipping them in an aqueous acidic solution of chitosan, so as to attain an enhancement in the quantity of the desired hydroxides attached thereto. This effect is particularly marked when zinc hydroxide is employed.

There are no particular restrictions on water-soluble copper and zinc compounds to be used in the present invention. Any copper and zinc compounds can be used only if they are soluble in water. As examples of such compounds, mention may be made of copper sulfate, copper chloride, copper nitrate, copper acetate, zinc sulfate, zinc chloride, zinc nitrate, zinc acetate, and the like.

As alkaline substances for providing alkalinity, there can be used any compounds which are capable of reacting with the above-described copper and zinc compounds to form colloidal copper hydroxide and/or zinc hydroxide. As examples of such alkaline substances, mention may be made of sodium hydroxide, potassium hydroxide, sodium carbonate, sodium bicarbonate, and the like. Of these compounds, sodium hydroxide and potassium hydroxide can be preferable because of easiness of the pH adjustment.

Deodorizing fibers obtained through the hydroxide-fixing treatment and, where desired, washing with water and drying described hereinbefore can be used as they are as a deodorizing material or can be shaped into a sheet-like product which is made by a conventional paper milling method or a three-dimensional product to be used as a deodorizing material.

Upon the production of shaped products, there can be used more than one kind of cellulose fibers which have copper and/or zinc hydroxide fixed thereon, and it is possible to use the cellulose fibers together with cellulose fibers and/or other fibers not fixed with copper and/or zinc hydroxide, within the limits where the required deodorizing capability can be satisfied. In cases where they are shaped into a sheet-like product, granules, or the like, it is possible to incorporate therein auxiliary agents conventionally used for paper milling, such as wet strength intensifiers, polymeric coagulants, etc., within the limits that the practical deodorizing capability of the shaped product is not impaired.

Furthermore, it is possible to subject the thus obtained shaped products to a secondary processing, such as surface printing, lamination with other materials, folding, and shaping into a three-dimensional form.

DETAILED DESCRIPTION OF PREFERRED EMBODIMENTS

The present invention will further be explained in detail by way of examples. However, the invention is by no means limited to these.

Analytical values shown in the examples were determined in the following manner:

(1) Concentration of Cu and Zn

Determined by the atomic absorption photometry.

(2) Relative viscosity

Measured in accordance with JIS P 8101.

(3) Moisture content in samples

Measured in accordance with JIS P 8203.

(4) Deodorizing capability

Into a 1.5 liter polyvinyl chloride bag were charged 1 g of a sample of a deodorant and 1.5 liters of a malodorous gas of a predetermined concentration (100 ppm in each case), and then the bag was sealed. The concentration of the malodorous gas remaining in the bag was measured with a gas detection tube immediately after the sealing and 10, 30 and 60 minutes after the sealing, and the remaining rate (%) of the gas was calculated therefrom.

EXAMPLES 1-3

To 20 liters of water was added 1,000 g of NBSP, of bleached sulfite pulps (used as a cellulose fiber), and the mixture was disaggregated to a pulpy state by using a disaggregator and then subjected to an acid treatment by the addition of an aqueous $SO_2$ solution up to a pH of 3.3. Subsequently, an aqueous copper sulfate solution containing 200 g/l of $CuSO_4.5H_2O$ was added thereto up to a concentration of 3 W/W% (reduced to copper and based on the weight of the NBSP). Then, the pH of the mixture was adjusted to 5.0, 6.0 or 9.5 (Example 1, 2 and 3, respectively) by using an aqueous solution of sodium hydroxide (120 g/l), whereby colloid of copper hydroxide was formed, and the colloid formed was attached to, and fixed on, the NBSP fibers to produce deodorizing fibers. The thus obtained fibers were shaped into sheets by using a sheet machine and then dried to give sheets of ca. 410 g/m$^2$. The quantity of copper hydroxide fixed on each sheet was determined (in W/W% reduced to copper and based on the weight of the NBSP), and the rate(%) of copper fixed, based on the weight of copper added, was calculated therefrom. Results obtained are shown in Table 1.

It would be apparent from the results that excellent fixed quantities and fixed rates could be attained at a pH of 6.0 and above.

EXAMPLES 4-6

To 20 liters of water was added 1,000 g of NBSP (cellulose fiber), and the mixture was disaggregated to a pulpy state by using a disaggregator, and its pH was adjusted to 3.0 by the addition of an aqueous $SO_2$ solution. Subsequently, an aqueous zinc sulfate solution containing 200 g/l of $ZnSO_4$ was added thereto up to a concentration of 3 W/W% (reduced to zinc and based on the weight of the NBSP). Then, the pH of the mixture was adjusted to 6.5, 8.0 or 9.5 (Example 4, 5 or 6, respectively) by using an aqueous solution of sodium hydroxide (120 g/l), whereby colloid of zinc hydroxide was formed, and the colloid formed was attached to, and fixed on, the NBSP fibers to produce deodorizing fibers. The thus obtained fibers were shaped into sheets by using a sheet machine and then dried to give sheets of ca. 410 g/m$^2$. The quantity of zinc hydroxide fixed on each sheet was determined (in W/W% reduced to zinc and based on the weight of the NBSP), and the rate(%) of zinc fixed, based on the weight of zinc added, was calculated therefrom. Results obtained are also shown in Table 1.

It would be apparent from the results that excellent fixed quantities and fixed rates could be attained at a pH of 8.0 and above.

EXAMPLES 7-9

To 20 liters of water was added 1,000 g of NBSP, and the mixture was disaggregated to a pulpy state by using a disaggregator and then subjected to an acid treatment by the addition of an aqueous $SO_2$ solution up to a pH of 3.3. Subsequently, an aqueous copper solution containing 200 g/l of $CuSO_4.5H_2O$ was added thereto in quantities as shown in Table 1 based on weight reduced to copper (Examples 7, 8 and 9). Then, the pH of the mixtures was adjusted to 8 by the addition of an aqueous solution of sodium hydroxide (120 g/l), whereby colloid of copper hydroxide was formed, and the colloid formed was attached to, and fixed on, the NBSP fibers to produce deodorizing fibers. The thus obtained fibers were shaped into sheets by using a sheet machine and then dried to give sheets of ca. 410 g/m$^2$.

The quantity of copper hydroxide fixed on each of the sheets was determined (in W/W% reduced to copper and based on the weight of the NBSP), and the rate(%) of copper fixed, based on the weight of copper added, was calculated therefrom. Results obtained are shown in Table 2.

Thereafter, deodorizing capability for $H_2S$ gas, $NH_3$ gas and methyl mercaptan gas of the products according to Examples 7, 8 and 9 was evaluated in accordance with the test method shown hereinbefore. Results obtained are also shown in Table 3.

It would be apparent from the results shown in Tables 2 and 3 that the deodorizing materials according to the invention are capable of effectively acting on such malodorous gaseous substances as $H_2S$, $NH_3$ and methyl mercaptan.

EXAMPLES 10-11

To 20 liters of water was added 1,000 g of NBSP (cellulose fiber), and the mixture was disaggregated to a pulpy state by using a disaggregator, and its pH was adjusted to 3.0 by the addition of an aqueous $SO_2$ solution. Subsequently, an aqueous zinc sulfate solution was added thereto up to a concentration of 2 or 6 W/W% (reduced to zinc and based on the weight of the NBSP) [Example 10 or 11, respectively]. Then, the pH of the mixtures was adjusted to 8 by the addition of an aqueous solution of sodium hydroxide (120 g/l), whereby colloid of zinc hydroxide was formed, and the colloid formed was attached to, and fixed on, the NBSP fibers to produce deodorizing fibers. The thus obtained fibers were shaped into sheets by using a sheet machine and then dried to give sheets of ca. 410 g/m$^2$.

The quantity of zinc hydroxide fixed on each of the sheets was determined (in W/W% reduced to zinc and based on the weight of the NBSP), and the rate(%) of zinc fixed, based on the weight of zinc added, was calculated therefrom. Results obtained are also shown in Table 2.

Thereafter, the deodorizing capability for $H_2S$ gas and $NH_3$ gas of the products according to Examples 10 and 11 was evaluated in accordance with the test method described hereinbefore. It would be apparent from the results shown in Table 2 that the cellulose fibers on which zinc hydroxide is fixed possess the capability of deodorizing $H_2S$ gas and $NH_3$ gas.

EXAMPLE 12

Disaggregated and acid treated slurry of NBSP fibers was prepared in the same manner as in the case of aqueous-copper sulfate solution in Example 9, and copper sulfate and zinc sulfate were added thereto in the same manner as in Example 9, up to a concentration of 2% by weight each (reduced to copper or zinc and based on the weight of the fibers). Subsequently, the pH of the mixture was adjusted to 8 by the addition of an aqueous solution of sodium hydroxide (120 g/l), whereby a copper hydroxide and zinc hydroxide-containing colloid was formed, and the colloid formed was attached to, and fixed on, the NBSP fibers to produce deodorizing fibers. The fibers obtained were shaped into a sheet by using a sheet machine and then dried to give a sheet of ca. 410 g/m$^2$.

Thereafter, the deodorizing capability for $H_2S$ gas and $NH_3$ gas of the thus obtained sheet was evaluated in accordance with the test method described hereinbefore. Results obtained are also shown in Table 2.

It would be apparent from the results shown in Table 2 that the deodorizing material according to the invention is capable of effectively acting on such malodorous gaseous substances as $H_2S$ and $NH_3$.

Fixed quantity:

Cu: 1.8% by weight

Zn: 1.3% by weight

Deodorizing capability:

| | Immediately after sealing | After 10 min. | After 30 min. | After 60 min. |
|---|---|---|---|---|
| $H_2S$ | 30 | 2 | 0 | |
| $NH_3$ | 19 | 7 | 0 | |

EXAMPLE 13

To 20 liters of water was added 1,000 g of NBSP (oxidized cellulose fiber), and the mixture was disaggregated to a slurry by using a disaggregator. An aqueous 1 wt % chitosan solution in 1 wt % acetic acid was added to the mixture, up to a concentration of chitosan of 1.0% by weight, based on the weight of the NBSP, and the resulting mixture was stirred for 15 minutes. Thereafter, an aqueous zinc sulfate solution was added thereto up to a concentration of zinc of 6 W/W%, based on the weight of the NBSP. Then, the pH of the mixture was adjusted to 8 by the addition of an aqueous solution of sodium hydroxide (120 g/l), whereby colloid of zinc hydroxide was formed, and the colloid formed was added to, and fixed on, the NBSP fibers to produce deodorizing fibers.

The fibers were shaped into a sheet by using a sheet machine and then dried to give a sheet of ca. 410 g/m$^2$.

Then, the quantity of zinc hydroxide fixed on the sheet was determined (in W/W% reduced to zinc and based on the weight of the NBSP), and the rate(%) of zinc fixed, based on the weight of zinc added, was calculated therefrom. Results obtained are also shown in Table 2.

Thereafter, the deodorizing capability for $H_2S$ gas and $NH_3$ gas of the product according to Examples 10–11 was evaluated in accordance with the test method described hereinbefore.

Fixed quantity: 4.9% by weight

Fixed rate: 79%

Deodorizing capability:

| | Immediately after sealing | After 10 min. | After 30 min. | After 60 min. |
|---|---|---|---|---|
| $H_2S$ | 29 | 2 | 0 | |
| $NH_3$ | 19 | 5 | 0 | |

EXAMPLE 14

To 20 liters of an alkaline solution whose pH had been adjusted to 9.5 by the addition of sodium hydroxide was added 1,000 g of NBSP, and the mixture was disaggregated to a slurry by using a disaggregator. Subsequently, an aqueous copper sulfate solution containing 200 g/l of $CuSO_4.5H_2)0$ was added thereto up to an amount of copper of 2% by weight, based on the weight of NBSP. Then, the pH of the mixture was adjusted to 8 by using an aqueous solution of sodium hydroxide (120 g/l), whereby colloid of copper hydroxide was formed, and the colloid formed was attached to, and fixed on, the NBSP to produce deodorizing fibers. The fibers were shaped into a sheet by using a sheet machine and then dried to give a sheet of 410 g/m$^2$.

The quantity of copper hydroxide fixed on the sheet was determined (in W/W% reduced to copper and based on the weight of the NBSP), and the rate(%) of copper fixed, based on the weight of zinc added, was calculated therefrom. Results obtained are also shown in Table 2.

Comparative Examples 1–2

To 20 liters of water was added 1,000 g of NBSP (cellulose fiber), and the mixture was disaggregated to a slurry by using a disaggregator. Subsequently, a 4 W/W% dispersion of commercially available copper hydroxide powders was added to the slurry of pulp up to a weight ratio of NBSP/Cu=98/2 or 94/4 (Comparative Example 1 or 2, respectively). After being stirred for 30 minutes, each of the mixtures was shaped into a sheet by using a sheet machine and then dried to give a sheet of ca. 410 g/m$^2$.

Copper hydroxide was not fixed well on any of the sheets, and powders of copper hydroxide dropped off when the sheets were rubbed with a finger.

Comparative Examples 3–4

To 20 liters of water was added 1,000 g of NBSP (cellulose fiber), and the mixture was disaggregated to a slurry by using a disaggregator. Subsequently, a 4 W/W% dispersion of commercially available zinc hydroxide powders was added to the slurry of pulp up to a weight ratio of NBSP/Zn=98/2 or 94/4 (Comparative Example 3 or 4, respectively). After being stirred for 30 minutes, each of the mixtures was shaped in a sheet by using a sheet machine and then dried to give a sheet of 410 g/m$^2$.

Zinc hydroxide was not fixed well on any of the sheets, and powders of copper hydroxide dropped off when the sheets were rubbed with a finger.

EXAMPLE 15

1,000 g of NDSP (used as a cellulose fiber) was added to 20 liters of water, disaggregated to the state of slurry by using a disaggregator and then subjected to an acid treatment by the addition of an aqueous $SO_2$ solution up to a pH of 3.3. Subsequently, an aqueous copper chloride solution ($CuCl_2.2H_2O$) was added thereto up to a concentration of 6 W/W% (reduced to copper and based on the weight of the NDSP). Then, the pH of the mixture was adjusted to 8 by the addition of an aqueous solution of sodium hydroxide (120 g/l), whereby colloid of copper hydroxide was formed, and the colloid formed was attached to, and fixed on, the NDSP fibers to produce deodorizing fibers.

The fibers were then shaped into a sheet by using a sheet machine and then dried to give a sheet of ca. 410 g/m$^2$.

The quantity of copper hydroxide fixed on the sheet was determined (in W/W% reduced to copper and based on the weight of the NDSP), and the rate(%) of copper fixed thereon, based on the weight of copper added, was calculated therefrom. Results obtained are also shown in Table 2.

Thereafter, the deodorizing capability for $H_2S$ gas and $NH_3$ gas of the sheet was evaluated in accordance with the test method described hereinbefore. Results obtained are shown in Table 2.

It would be apparent from the results shown in Table 2 that the object of the present invention can also be attained in the case where copper chloride is used for the formation of copper hydroxide colloid.

EXAMPLE 16

1,000 g of cotton wool (used as a cellulose fiber) was added to 20 liters of water, disaggregated to the state of slurry by using a disaggregator and then subjected to an acid treatment by the addition of an aqueous $SO_2$ solution up to a pH of 3.3. Subsequently, an aqueous copper sulfate solution containing 200 g/l of $CuSO_4.5H_2O$ was added thereto up to a concentration of 4 W/W% (reduced to copper and based on the weight of the cotton wool). Thereafter, the pH of the mixture was adjusted to 8 by the addition of an aqueous solution of sodium hydroxide (120 g/l), whereby colloid of copper hydroxide was formed, and the colloid formed was attached to, and fixed on, the cotton wool to give deodorizing fibers.

The thus obtained dispersion was shaped into a sheet by using a sheet machine and then dried to give a sheet of ca. 410 g/m$^2$.

The quantity of copper hydroxide fixed on the sheet was determined (in W/W% reduced to copper and based on the weight of the cotton wool), and the rate(%) of copper fixed thereon, based on the weight of copper added, was calculated therefrom. Results obtained are also shown in Table 2.

Thereafter, the deodorizing capability for $H_2S$ gas and $NH_3$ gas of the sheet was evaluated in accordance with the test method described hereinbefore. Results obtained are shown in Table 2.

It would be apparent from the results shown in Table 2 that the object of the present invention can also be attained by using cotton wool.

EXAMPLE 17

1,000 g of rayon (used as a cellulose fiber) was added to 20 liters of water, disaggregated to the state of slurry by using a disaggregator and then subjected to an acid treatment by the addition of an aqueous $SO_2$ solution up to a pH of 3.3. Subsequently, an aqueous copper sulfate solution containing 200 g/l of $CuSO_4.5H_2O$ was added thereto up to a concentration of 4 W/W% (reduced to copper and based on the weight of the rayon). Thereafter, the pH of the mixture was adjusted to 8 by the addition of an aqueous solution of sodium hydroxide (120 g/l), whereby colloid of copper hydroxide was formed, and the colloid formed was attached to, and fixed on, the rayon fibers to give deodorizing fibers.

The fibers obtained were shaped into a sheet by using a sheet machine and then dried to give a sheet of ca. 410 g/m$^2$.

The quantity of copper hydroxide fixed on the sheet was determined (in W/W% reduced to copper and based on the weight of the rayon) and the rate(%) of copper fixed, based on the weight of the copper added, was calculated therefrom. Results obtained are also shown in Table 2.

Thereafter, deodorizing capability for $H_2S$ gas and $NH_3$ gas of the sheet was evaluated in accordance with the test method described hereinbefore Results obtained are shown in Table 2.

It would be apparent from the results shown in Table 2 that the objects of the present invention can also be attained by using rayon.

EXAMPLE 18

100 g of NBKP (used as a cellulose fiber) was dipped in 300 g of water and then ground by a grinder.

Subsequently, an aqueous $SO_2$ solution was added thereto up to a pH of 3, and after being stirred further, an aqueous copper sulfate solution containing 200 g/l of $CuSO_4.5H_2O$ was added thereto up to a concentration of 4 W/W% (reduced to copper and based on the weight of the NBKP). Thereafter, an aqueous solution of sodium hydroxide (120 g/l was added up to a pH of 8, and the mixture was stirred further to prepare a dispersion. In a separate operation, a dispersion was prepared by disaggregating untreated NBKP to the state of slurry, and then admixed with the dispersion prepared above at a ratio of 1:1, based on the weight of solids. The resulting product was shaped into a sheet by using a sheet machine and dried to give a sheet of ca. 410 g/m$^2$.

The deodorizing capability for $H_2S$ gas and NH gas of the sheet was evaluated in accordance with the test method described hereinbefore. Results obtained are shown in Table 2.

EXAMPLE 19

A sheet was prepared in the same manner as in Example 16, and 5 g of the sheet was dipped with stirring in 50 ml of diluted aqueous ammonia solution (concentration: 2,000 ppm). After it had been allowed to stand for 1 hour, it was tried to smell the odor of ammonia of the aqueous solution, but no ammonia odor was detected.

EXAMPLE 20

A sheet was prepared in the same manner as in Example 16, and 5 g of the sheet was dipped with stirring in 50 ml of diluted aqueous $H_2S$ solution (concentration: 4,000 ppm). After it had been allowed to stand for 1 hour, it was tried to smell the odor of $H_2S$, but no $H_2S$ odor was detected.

EXAMPLE 21

1,000 g of cotton wool (cellulose fiber) was added to 20 liters of water and disaggregated to the state of slurry by using a disaggregator, and then an aqueous $SO_2$ solution was added thereto up to a pH of 3.0. Subsequently, an aqueous solution of zinc chloride (200 g/l) was added thereto up to a concentration of 4 W/W% (reduced to zinc and based on the weight of the cotton wool). The pH of the mixture was adjusted to 8 by the addition of an aqueous solution of sodium hydroxide (120 g/l), whereby colloid of zinc hydroxide was formed, and the colloid formed was attached to, and fixed on, the cotton wool to produce deodorizing fibers. The fibers obtained were shaped into a sheet by using a sheet machine and dried to give a sheet of ca. 410 g/m$^2$.

The quantity of zinc hydroxide fixed was 3.2 W/W% (reduced to zinc and based on the weight of the cotton wool), and the rate(%) of zinc fixed was 80 W/W%, based on the weight of zinc added.

5 g of the sheet was dipped with stirring in 50 ml of diluted aqueous ammonia solution (concentration: 2,000 ppm). After it had been allowed to stand for 1 hour, it was tried to smell the odor of ammonia of the aqueous solution, but no ammonia odor was detected.

EXAMPLE 22

1,000 g of rayon (cellulose fiber) was added to 20 liters of water and disaggregated to the state of slurry by using a disaggregator, and then an aqueous $SO_2$ solution was added thereto up to a pH of 3.0. Subsequently, an aqueous solution of zinc chloride (200 g/l) was added thereto up to a concentration of 4 W/W% (reduced to zinc and based on the weight of the rayon).

Then, an aqueous solution of sodium hydroxide (120 g/l) was added thereto to adjust its pH to 8, whereby colloid of zinc hydroxide was formed, and the colloid formed was attached to, and fixed on, the rayon fibers to produce deodorizing fibers.

The fibers obtained were shaped into a sheet by using a sheet machine and dried to give a sheet of ca. 410 g/m$^2$.

The quantity of zinc fixed was 2.8 W/W% (reduced to zinc and based on the weight of rayon), and the rate(%) of zinc fixed was 70 W/W%, based on the weight of zinc added.

5 g of the sheet was dipped with stirring in 50 ml of diluted aqueous $H_2S$ solution (concentration: 4,000 ppm). After it had been allowed to stand for 1 hour, it was tried to smell the odor of $H_2S$ of the aqueous solution, but no $H_2S$ odor was detected.

Copper hydroxide and/or zinc hydroxide can be fixed on cellulose fibers by attaching copper hydroxide and/or zinc hydroxide in a colloidal state onto cellulose fibers in accordance with the process of the present invention. Copper hydroxide and/or zinc hydroxide so fixed are capable of acting on, and exhibiting excellent deodorizing capability for, malodorous gaseous substances, such as hydrogen sulfide, ammonia, methyl mercaptan, etc., in particular, ammonia and hydrogen sulfide, or for ammonia, hydrogen sulfide, etc. dissolved in water.

The deodorizing fibers can be an excellent deodorizer as they are. The fibers, since they are in fibrous form, are also excellent in their processability and can be shaped into a product of any desired shape, including sheets or the like. They are therefore usable as a deodorizing material and can be applied to various uses in the field of deodorization.

TABLE 1

| | pH | Amount Fixed (W/W %) | Fixed Rate (%) |
|---|---|---|---|
| Example 1 | 5.0 | 0.2 | 7 |
| Example 2 | 6.0 | 2.0 | 67 |
| Example 3 | 9.5 | 2.5 | 83 |
| Example 4 | 6.5 | 0.2 | 7 |
| Example 5 | 8.0 | 1.8 | 60 |
| Example 6 | 9.5 | 2.3 | 77 |

What is claimed is:

1. A process for producing deodorizing fibers, comprising adding an alkaline substance to an aqueous solution containing at least one water-soluble compound selected from the group consisting of copper compounds and zinc compounds so as to form a colloid comprising hydroxide of said at least one water-soluble compound by adjusting the pH of said aqueous solution such that, in cases wherein said water-soluble compound is copper, said pH is from 5.0 to 12.0, and, in cases wherein said water-soluble compound is zinc, said pH is from 6.2 to 12.0, and attaching said hydroxide of said at least one water-soluble compound to cellulose fibers.

2. The process of claim 1, wherein said water-soluble compound is a copper compound, and wherein said pH of said aqueous solution of said water-soluble copper compound is from 6.0 to 12.0.

3. The process of claim 1, wherein said water-soluble compound is a zinc compound, and wherein said pH of said aqueous solution of said water-soluble zinc compound is from 8.0 to 12.0.

4. A process for producing deodorizing fibers, comprising adding acid to an aqueous solution containing at least one water-soluble compound selected from the group consisting of copper compounds and zinc compounds to make the pH less than 3.0, and subsequently adding an alkaline substance to said aqueous solution to adjust the pH of said aqueous solution such that, in the case wherein said water-soluble compound is a copper compound, said pH is from 6.0 to 12.0, and, wherein said water-soluble compound is a zinc compound, said pH is from 8.0 to 12.0, thereby forming a colloid comprising hydroxide of said at least one water-soluble compound, and attaching said hydroxide of said water-soluble compound to cellulose fibers.

5. The process of claim 4, wherein said pH of said aqueous solution containing said colloid comprising hydroxide of at least one water-soluble compound is from 8.0 to 9.5.

TABLE 2

| | Cu or Zn components | | | $H_2S$ Gas | | | | $NH_3$ Gas | | | |
|---|---|---|---|---|---|---|---|---|---|---|---|
| | | Amount | Fixed | Immediately | Time Lapsed | | | Immediately | Time Lapsed | | |
| | Amount Added | Fixed (W/W %) | Rate (%) | After Start | 10 Min. | 30 Min. | 60 Min. | After Start | 10 Min. | 30 Min. | 60 Min. |
| Example 7 | 0.05 | 0.05 | 80 | 62 | 35 | 15 | 0 | 22 | 21 | 12 | 10 |
| Example 8 | 0.5 | 0.4 | 80 | 45 | 4 | 0 | | 20 | 12 | 8 | 3 |
| Example 9 | 2 | 1.8 | 90 | 12 | 3 | 0 | | 10 | 1 | 0 | |
| Example 10 | 2 | 1.5 | 75 | 22 | 6 | 0 | | 20 | 10 | 5 | 5 |
| Example 11 | 6 | 3.8 | 63 | 30 | 2 | 0 | | 21 | 7 | 2 | 1 |
| | Cu 2 | Cu 1.8 | 90 | | | | | | | | |
| Example 12 | Zn 2 | Zn 1.3 | 65 | 30 | 2 | 0 | | 19 | 7 | 0 | |
| Example 13 | 4 | 4.9 | 79 | 29 | 2 | 0 | | 19 | 5 | 0 | 9 |
| Example 14 | 2 | 1.9 | 95 | 31 | 8 | 0 | | 30 | 12 | 10 | 11 |
| Example 15 | 6 | 3.8 | 63 | 28 | 2 | 0 | | 20 | 8 | 0 | |
| Example 16 | 4 | 2.9 | 72 | 10 | 0 | | | 60 | 35 | 20 | 35 |
| Example 17 | 4 | 2.7 | 68 | 6 | 0 | | | 21 | 17 | 7 | 9 |
| Example 18 | 4 | 2.7 | 68 | 31 | 3 | 0 | | 60 | 28 | 10 | 21 |

TABLE 3

| | Cu Component | | | Methyl Mercaptan Gas | | | |
|---|---|---|---|---|---|---|---|
| | | Amount | Fixed | Immediately | Time Lapsed | | |
| | Amount Added | Fixed (W/W %) | Rate (%) | After Start | 10 Min. | 30 Min. | 60 Min. |
| Example 7 | 0.05 | 0.04 | 80 | 30 | 26 | 20 | 10 |
| Example 8 | 0.5 | 0.4 | 80 | 25 | 25 | 15 | 10 |
| Example 9 | 2 | 1.8 | 90 | 10 | 5 | 5 | 5 |

6. The process of claim 4, wherein said cellulose fibers are pre-treated in an acid.

7. The process of claim 4, wherein said cellulose fibers are pre-treated by immersion in an aqueous solution of chitosan.

8. Deodorizing fibers comprising cellulose fibers on which at least one compound selected from the group consisting of copper hydroxide and zinc hydroxide if fixed through contact between a solution containing a colloid of said at least one compound and said cellulose.

9. Deodorizing fibers of claim 8, wherein said cellulose fibers are pre-treated by immersion in a solution of chitosan.

10. Deodorizing fibers of claim 8, wherein said cellulose fibers are pulp fibers.

11. Deodorizing materials comprising deodorizing fibers on which at least one compound selected from the group consisting of copper hydroxide and zinc hydroxide is fixed through contact between a colloid of said at least one compound and cellulose fibers.

12. Deodorizing materials of claim 11, wherein said materials are in the form of a sheet.

* * * * *